US008857945B2

(12) United States Patent
Tunmore et al.

(10) Patent No.: US 8,857,945 B2
(45) **Date of Patent: *Oct. 14, 2014**

(54) MULTI-ZONE CONDENSATION CONTROL SYSTEM FOR INKJET PRINTER

(75) Inventors: David F. Tunmore, Xenia, OH (US); Timothy John Hawryschuk, Miamisburg, OH (US)

(73) Assignee: Eastman Kodak Company, Rochester, NY (US)

( * ) Notice: Subject to any disclaimer, the term of this patent is extended or adjusted under 35 U.S.C. 154(b) by 238 days.

This patent is subject to a terminal disclaimer.

(21) Appl. No.: 13/461,836

(22) Filed: May 2, 2012

(65) Prior Publication Data

US 2013/0293620 A1 Nov. 7, 2013

(51) Int. Cl.
*B41J 29/38* (2006.01)
*B41J 2/045* (2006.01)

(52) U.S. Cl.
CPC ..... *B41J 2/04563* (2013.01); *B41J 2/04528* (2013.01)
USPC ..... 347/17; 347/34

(58) Field of Classification Search
CPC .. B41J 2/04563; B41J 2/0458; B41J 2/04528; B41J 2/04541; B41J 2/04553
USPC ..... 347/17, 29, 34, 26, 35, 73–82
See application file for complete search history.

(56) References Cited

U.S. PATENT DOCUMENTS

| | | | | |
|---|---|---|---|---|
| 6,517,197 | B2 | 2/2003 | Hawkins et al. | |
| 2012/0081455 | A1 * | 4/2012 | Kritchman et al. | 347/20 |
| 2013/0141491 | A1 * | 6/2013 | Krichtman et al. | 347/30 |

* cited by examiner

*Primary Examiner* — Manish S Shah
*Assistant Examiner* — Yaovi Ameh
(74) *Attorney, Agent, or Firm* — Roland R. Schindler; William R. Zimmerli

(57) ABSTRACT

Inkjet printing systems are provided. In one aspect an inkjet printing system has a plurality of inkjet printheads, a plurality of caps are provided with each cap has a thermally insulating separator that positions a shield between the face of one of the printheads and the target area for the printhead and creating a printing region between the shield and the target area and a shielded region between the face and the shield. The shield has at least one opening through the shield through which the nozzles of the printhead can jet the ink droplets to the target area. An energy source provides energy that can be applied to cause the shields to be heated.

24 Claims, 14 Drawing Sheets

MULTI-ZONE CONDENSATION CONTROL SYSTEM FOR INKJET PRINTER

CROSS REFERENCE TO RELATED APPLICATIONS

This application relates to commonly assigned, copending U.S. application Ser. No. 13/461,827, filed May 2, 2012, entitled: "INKJET PRINTING SYSTEM WITH CONDENSATION CONTROL SYSTEM"; U.S. application Ser. No. 13/461,831, filed May 2, 2012, now U.S. Pat. No. 8,562,115, entitled: "CONDENSATION CONTROL IN AN INKJET PRINTING SYSTEM"; U.S. application Ser. No. 13/461,832, filed May 2, 2012, entitled: "INKJET PRINTER WITH IN-FLIGHT DROPLET DRYING SYSTEM"; U.S. application Ser. No. 13/461,834, filed May 2, 2012, entitled: "IN-FLIGHT INK DROPLET DRYING METHOD"; U.S. application Ser. No. 13/461,838, filed May 2, 2012, entitled: "MULTI-ZONE CONDENSATION CONTROL METHOD"; U.S. application Ser. No. 13/461,845, filed May 2, 2012, entitled: "INKJET PRINTER WITH CONDENSATION CONTROL AIRFLOW SYSTEM"; U.S. application Ser. No. 13/461,850, filed May 2, 2012, entitled: "INKJET PRINTER WITH CONDENSATION CONTROL AIRFLOW METHOD", and U.S. application Ser. No. 13/217,715, filed Aug. 25, 2011, now U.S. Pat. No. 8,454,108, each of which is hereby incorporated by reference.

FIELD OF INVENTION

The present invention relates to controlling condensation of vaporized liquid components of inkjet inks during inkjet ink printing.

BACKGROUND OF THE INVENTION

In an ink jet printer, a print is made by ejecting or jetting a series of small droplets of ink onto a paper to form picture elements (pixels) in an image-wise pattern. The density of a pixel is determined by the amount of ink jetted onto an area. Control of pixel density is generally achieved by controlling the number of droplets of ink jetted into an area of the print. To produce a print containing a single color, for example a black and white print, it is only necessary to jet a single black ink so that more droplets are directed at areas of higher density than areas with lower density.

Color prints are generally made by jetting, in register, inks corresponding to the subtractive primary colors cyan, magenta, yellow, and black. In addition, specialty inks can also be jetted to enhance the characteristics of a print. For example, custom colors to expand the color gamut, low density inks to expand the gray scale, and protective inks such as those containing UV absorbers can also be jetted to onto a paper to form a print.

Ink jet inks are generally jetted onto the paper using a jetting head. Such heads can jet continuously using a continuously jetting print head, with ink jetted towards unmarked or low density areas deflected into a gutter and recycled back into the ink reservoir. Alternatively, ink can be jetted only where it is to be deposited onto the paper using a so-called drop on demand print head. Commonly used heads eject or jet droplets of ink using either heat (a thermal print head) or a piezoelectric pulse (a piezoelectric print head) to generate the pressure on the ink in a nozzle of the print head to cause the ink to fracture into a droplet and eject from the nozzle.

Ink jet printers can broadly be classified as serving one of two markets. The first is the consumer market, where printers are slow; typically printing a few pages per minute and the number of pages printed is low. The second market consists of commercial printers, where speeds are typically at least hundreds of pages per minute for cut sheet printers and hundreds of feet per minute for web printers. For use in the commercial market, ink jet prints must be actively dried as the speed of the printers precludes the ability to allow the prints to dry without specific drying subsystems.

FIG. 1 is a system diagram of one example of a prior art commercial printing system 2. In the example of FIG. 1, commercial printing system 2 has a supply 4 of a paper 6 and a transport system 8 for moving paper 6 past a plurality of printheads 10A, 10B, and 10C. Printheads 10A, 10B and 10C eject ink droplets onto paper 6 as paper 6 is moved past printheads 10A, 10B and 10C by transport system 8. Transport system 8 then moves paper 6 to an output area 14. In this example, paper 6 is shown as a continuous web that is drawn from a spool type supply 4, past printheads 10A, 10B and 10C to an output area 14 where the printed web is wound on to a spool 18. In the embodiment illustrated here, transport system 8 comprises a motor that rotates spool 18 to pull paper 6 past printheads 10A, 10B and 10C.

Inkjet inks generally comprise up to about 97% water or another jettable carrier fluid such as an alcohol that carries colorants such as dyes or pigments dissolved or suspended therein to the paper. Ink jet inks also conventionally include other materials such as humectants, biocides, surfactants, and dispersants. Protective materials such as UV absorbers and abrasion resistant materials may also be present in the inkjet inks. Any of these may be in a liquid form or may be delivered by means of a liquid carrier or solvent. Conventionally, these liquids are selected to quickly vaporize after printing so that a pattern of dry colorants and other materials forms on the receiver soon after jetting.

Commercial inkjet printers typically print at rates of more than fifty feet of printing per minute. This requires printheads 10A, 10B and 10C to eject millions of droplets 12A, 12B and 12C of inkjet ink per minute. Accordingly, substantial volumes of liquids are ejected and begin evaporating at each of printheads 10A, 10B and 10C during operation of such printers.

When an ink jet image is printed on an absorbent paper, the inkjet ink droplets penetrate and are rapidly absorbed by the paper. As the ink is absorbed into the paper, the carrier fluid in the ink droplets spread colorants. A certain extent of spreading is anticipated and this spreading achieves the beneficial effect of increasing the extent of a surface area of the paper colored by the inkjet ink color. However, where spreading exceeds an expected extent, printed images can exhibit any or all of a loss of resolution, a decrease in color saturation, a decrease in density or image artifacts created by unintended combinations of colorants.

Absorption of the carrier fluid from inkjet inks can also have the effect of modifying the dimensional stability of an absorbent paper. In this regard it will be appreciated that the process of paper fabrication creates stresses in the paper that are balanced to create a flat paper stock. However, wetting of the paper partially or completely releases such stresses. In response, the paper cockles and distorts creating significant difficulties during subsequent paper handling, printing, or finishing applications. Cockle and distortion can reduce color to color registration, color saturation, and print density. In addition, cockle and distortion of a print can impede the ability of a printing system to print front and back sides of a paper in register, often referred to as justification.

Further, in some situations, the jetting of large amounts of inkjet ink onto an absorbent paper can reduce the web strength of the paper. This can be particularly problematic in printers such as inkjet printing system 2 that is illustrated in FIG. 1, where, paper 6 is advanced by pulling the paper as the pulling applies additional external stresses to the paper that can further distort the paper.

Semi-absorbent papers absorb the ink more slowly than do absorbent papers. Inkjet printing on semi-absorbent papers can cause liquids from the inkjet ink to remain in liquid form on a surface of the paper for a period of time. Such ink is subject to smearing and offsetting if another surface contacts the printed surface before the carrier fluid in the ink evaporates. Air flow caused by either a drying process or by the transport of the receiver can also distort the wet print. Finally, external contaminants such as dust or dirt can adhere to the wet ink, resulting in image degradation.

To avoid these effects, high speed inkjet printed papers are frequently actively dried using one or more dryers such as dryers 16A, 16B and 16C shown in FIG. 1. Dryers 16A, 16B and 16C typically heat the printed paper and ink, to increase the evaporation rate of carrier fluid from paper 6 in order to reduce drying times. As is shown in FIG. 1, dryers 16A, 16B and 16C are typically positioned as close to the jetting assembly as possible so that the ink is dried in as short a time as possible after being jetted onto the paper. Indeed, it would be desirable to position the dryer subsystem in the vicinity of the jetting module.

However, the increased the rate at which carrier fluid evaporates creates localized concentrations of vaporized carrier fluid 17 around printing heads 10A, 10B and 10C. Further, movement of paper 6 through printer 2 drags air and carrier fluid along with paper 6 forming an envelope of air with carrier fluid vapor therein that travels along with printed paper 6 as printed paper 6 moves from print head 10A, to printhead 10B and on to printhead 10C. Accordingly, when a printed portion of paper 6 reaches second printing area 10B a second inkjet image is printed and dried, the concentration of carrier fluid vapor in the air between second printhead 10B and paper 6 is further increased. A similar result occurs at printhead 10C.

These concentrations increase the probability that vaporized carrier fluids 17 will condense on structures within the printer that are at temperature that is below a condensation point of the evaporated carrier fluid. Such condensation can create electrical shorts, cause corrosion and can interfere with ink jet droplet formation. Further, there is the risk that such condensates will form droplets 19 on structures such as printhead 10B or printhead 10C from which they can fall, transfer or otherwise come into contact with a printed paper so as to create image artifacts on the paper. This risk is particularly acute for structures that are in close proximity to a paper path through the printer.

One particular risk is the risk of problems created by such condensates at the inkjet printheads. When condensates form in such locations the condensates can combine with carrier fluid in ink droplets jetted toward a receiver to create image artifacts and can also interfere with droplet formation and negatively influence the flight path taken by the droplets. Accordingly, it is desirable to provide some level of protection against the formation of such drops of condensation at the printhead.

It will also be appreciated that it is frequently the case that several printheads are used in proximity to form what is known in the art as a printing module or linehead. Concentrations of vaporized carrier fluid can vary significantly at different printheads in the printing module. Accordingly, what is also needed is an ability to provide condensation protection for a plurality of printheads and to do so in a manner that allows for individualized adjustment at the printheads.

SUMMARY OF THE INVENTION

Inkjet printing systems are provided. In one aspect an inkjet printing system has a plurality of inkjet printheads, a plurality of caps are provided with each cap has a thermally insulating separator that positions a shield between the face of one of the printheads and the target area for the printhead and creating a printing region between the shield and the target area and a shielded region between the face and the shield. The shield has at least one opening through the shield through which the nozzles of the printhead can jet the ink droplets to the target area. An energy source provides energy that can be applied to cause the shields to be heated.

DETAILED DESCRIPTION OF THE INVENTION

Figure 2:
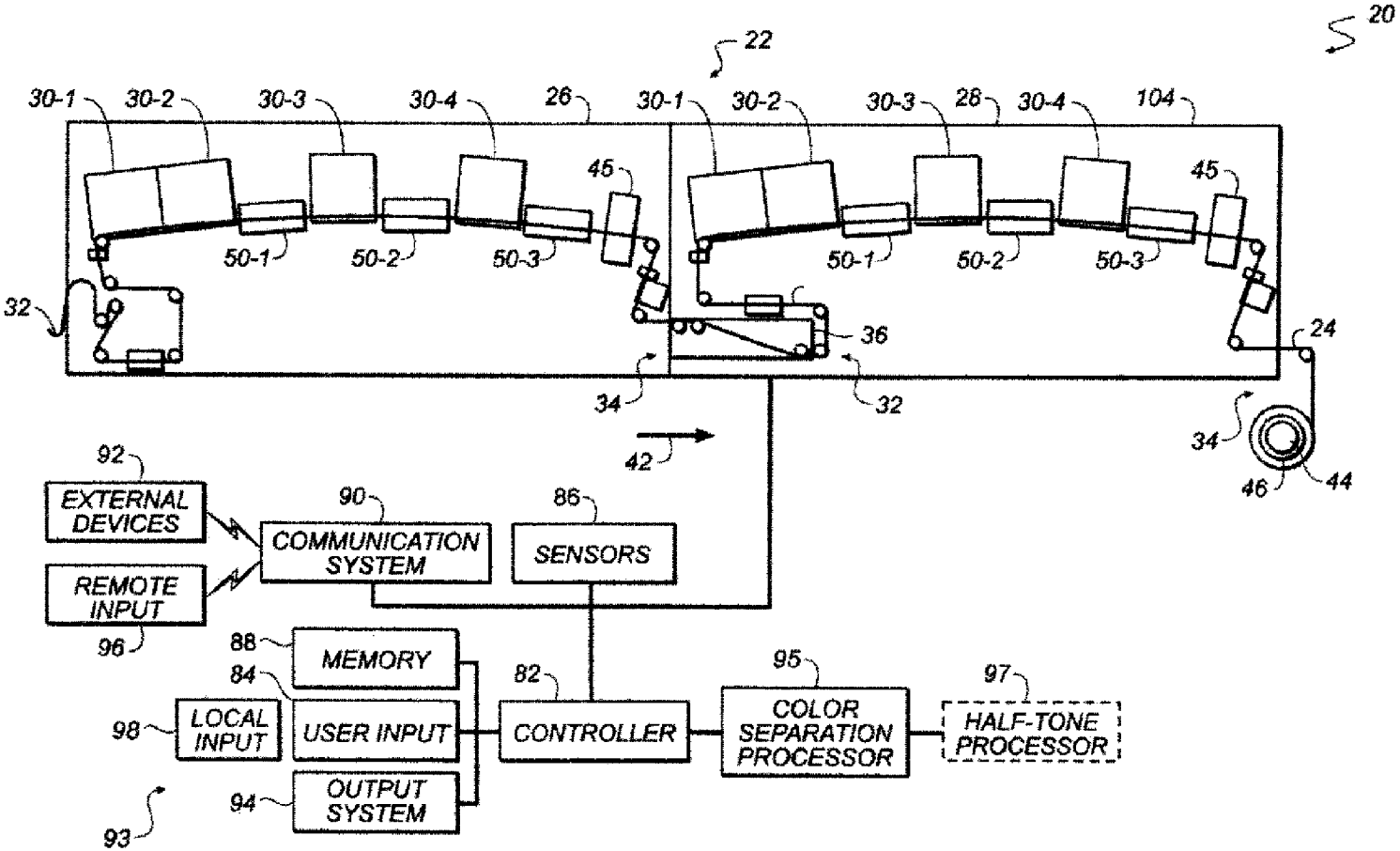
FIG. 2 illustrates a side schematic view of one embodiment of an inkjet printing system.

FIG. 2 is a side schematic view of a first embodiment of an inkjet printing system 20. Inkjet printing system 20 has an inkjet print engine 22 that delivers one or more inkjet images in registration onto a receiver 24 to form a composite inkjet image. Such a composite inkjet image can be used for any of a plurality of purposes, the most common of which is to provide a printed image with more than one color. For example, in a four color image, four inkjet images are formed, with each inkjet image having one of the four subtractive primary colors, cyan, magenta, yellow, and black. The four color inkjet inks can be combined to form a representative spectrum of colors. Similarly, in a five color image various combinations of any of five differently colored inkjet inks can be combined to form a color print on receiver 24. That is, any of five colors of inkjet ink can be combined with inkjet ink of one or more of the other colors at a particular location on receiver 24 to form a color after a fusing or fixing process that is different than the colors of the inkjets inks applied at that location.

In the embodiment of FIG. 2, inkjet print engine 22 is optionally configured with a first side print engine module 26 and a second print engine module 28. In this embodiment, first side print engine and second print engine module 28 have corresponding sequences of printing modules 30-1, 30-2, 30-3, 30-4, also known as lineheads that are positioned along a direction of travel 42 of receiver 24. Printing modules 30-1, 30-2, 30-3, 30-4 each have an arrangement of printheads (not shown in FIG. 2) to deliver inkjet droplets to form picture elements that create a single inkjet image 25 on a receiver 24 as receiver 24 is advanced from an input area 32 to an output area 34 by a receiver transport system 40 along the direction of travel 42.

Receiver transport system 40 generally comprises structures, systems, actuators, sensors, or other devices used to advance a receiver 24 from an input area 32 past print engine 22 to an output area 34. In FIG. 2, receiver transport system 40 comprises a plurality of rollers R, and optionally other forms of contact surfaces that are known in the art for guiding and directing a continuous type receiver 24. As is also shown in the embodiment of FIG. 2, first print engine module 26 has an output area 34 that is connected to an input area 32 of second print engine module 28 by way of an inverter module 36. In operation, receiver 24 is first moved past first print engine module 26 which forms one or more inkjet images on a first side of receiver 24, and is then inverted by inverter module 36 so that second print engine module 28 forms one or more inkjet images in registration with each other on a second side of receiver 24. A motor 44 is positioned proximate to output area 34 of second print engine module 28 that rotates a spool 46 to draw receiver 24 through first print engine module 26 and second print engine module 28. Additional driven rollers in the first print engine module 26 and in the second print engine module 28 can be used to maintain a desired tension in receiver 24 as it passes through printing system 22.

Figure 3:
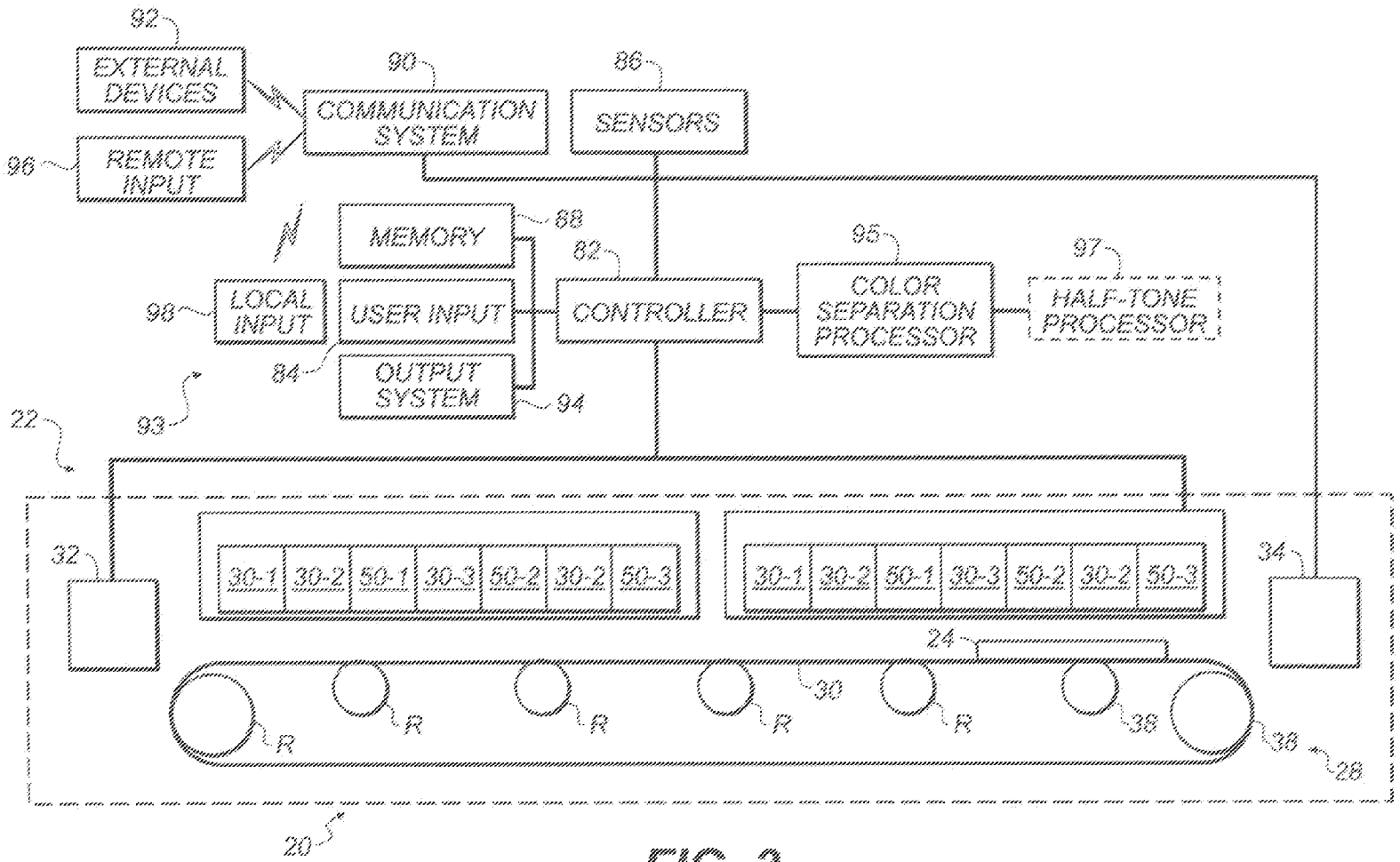
FIG. 3 illustrates a side schematic view of another embodiment of an inkjet printing system.

In an alternate embodiment illustrated in FIG. 3, a print engine 22 is optionally illustrated with only a first print engine module 26 and with a receiver transport system 40 that includes a movable surface such as an endless belt 30 that is that is supported by rollers R which in turn is operated by a motor 44. Such an embodiment of a receiver transport system 40 is particularly useful when receiver 24 is supplied in the form of pages as opposed to a continuous web. However, in other embodiments receiver transport system 40 can take other forms and can be provided in segments that operate in different ways or that use different structures. Other conventional embodiments of a receiver transport system can be used.

Printer 20 is operated by a printer controller 82 that controls the operation of print engine 22 including but not limited to each of the respective printing modules 30-1, 30-2, 30-3, 30-4 of first print engine module 26 and second print engine module 28, receiver transport system 40, input area 32, to form inkjet images in registration on a receiver 24 or an intermediate in order to yield a composite inkjet image 27 on receiver 24.

Printer controller 82 operates printer 20 based upon input signals from a user input system 84, sensors 86, a memory 88 and a communication system 90. User input system 84 can comprise any form of transducer or other device capable of receiving an input from a user and converting this input into a form that can be used by printer controller 82. Sensors 86 can include contact, proximity, electromagnetic, magnetic, or optical sensors and other sensors known in the art that can be used to detect conditions in printer 20 or in the environment-surrounding printer 20 and to convert this information into a form that can be used by printer controller 82 in governing printing, drying, other functions.

Memory 88 can comprise any form of conventionally known memory devices including but not limited to optical, magnetic or other movable media as well as semiconductor or other forms of electronic memory. Memory 88 can contain for example and without limitation image data, print order data, printing instructions, suitable tables and control software that can be used by printer controller 82.

Communication system 90 can comprise any form of circuit, system or transducer that can be used to send signals to or receive signals from memory 88 or external devices 92 that are separate from or separable from direct connection with printer controller 82. External devices 92 can comprise any type of electronic system that can generate signals bearing data that may be useful to printer controller 82 in operating printer 20.

Printer 20 further comprises an output system 94, such as a display, audio signal source or tactile signal generator or any other device that can be used to provide human perceptible signals by printer controller 82 to an operator for feedback, informational or other purposes.

Printer 20 prints images based upon print order information. Print order information can include image data for printing and printing instructions from a variety of sources. In the embodiment of FIGS. 2 and 3, these sources include memory 88, communication system 90, that printer 20 can receive such image data through local generation or processing that can be executed at printer 20 using, for example, user input system 84, output system 94 and printer controller 82. Print order information can also be generated by way of remote input 56 and local input 66 and can be calculated by printer controller 82. For convenience, these sources are referred to collectively herein as source of print order information 93. It will be appreciated, that this is not limiting and that the source of print order information 93 can comprise any electronic, magnetic, optical or other system known in the art of printing that can be incorporated into printer 20 or that can cooperate with printer 20 to make print order information or parts thereof available.

In the embodiment of printer 20 that is illustrated in FIGS. 2 and 3, printer controller 82 has an optional color separation image processor 95 to convert the image data into color separation images that can be used by printing modules 30-1, 30-2, 30-3, 30-4 of print engine 22 to generate inkjet images. An optional half-tone processor 97 is also shown that can process the color separation images according to any half-tone screening requirements of print engine 22.

Figure 1:
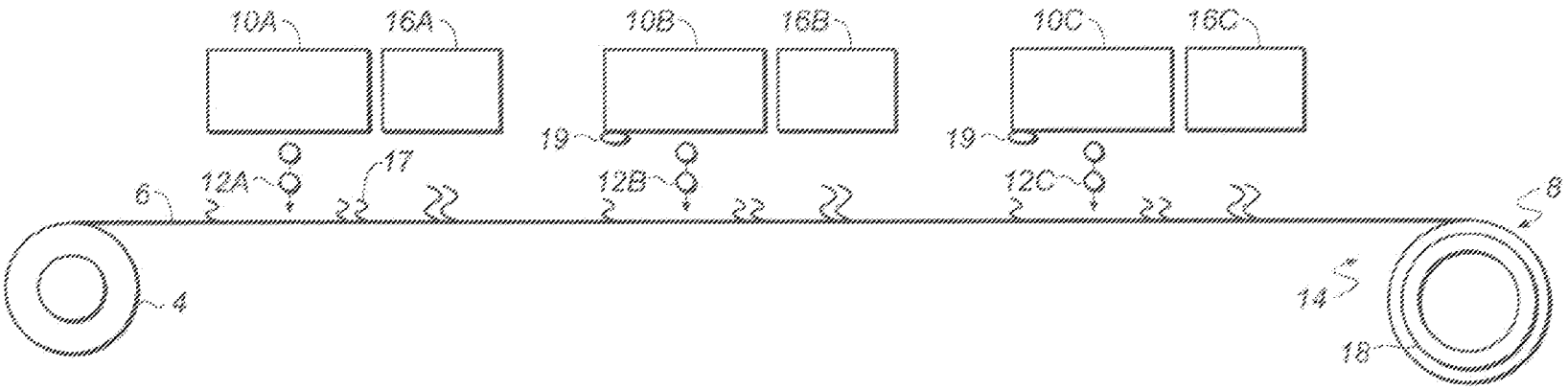
FIG. 1 (PRIOR ART)
FIG. 1 illustrates a side schematic view of a prior art inkjet printing system.
Figure 4:
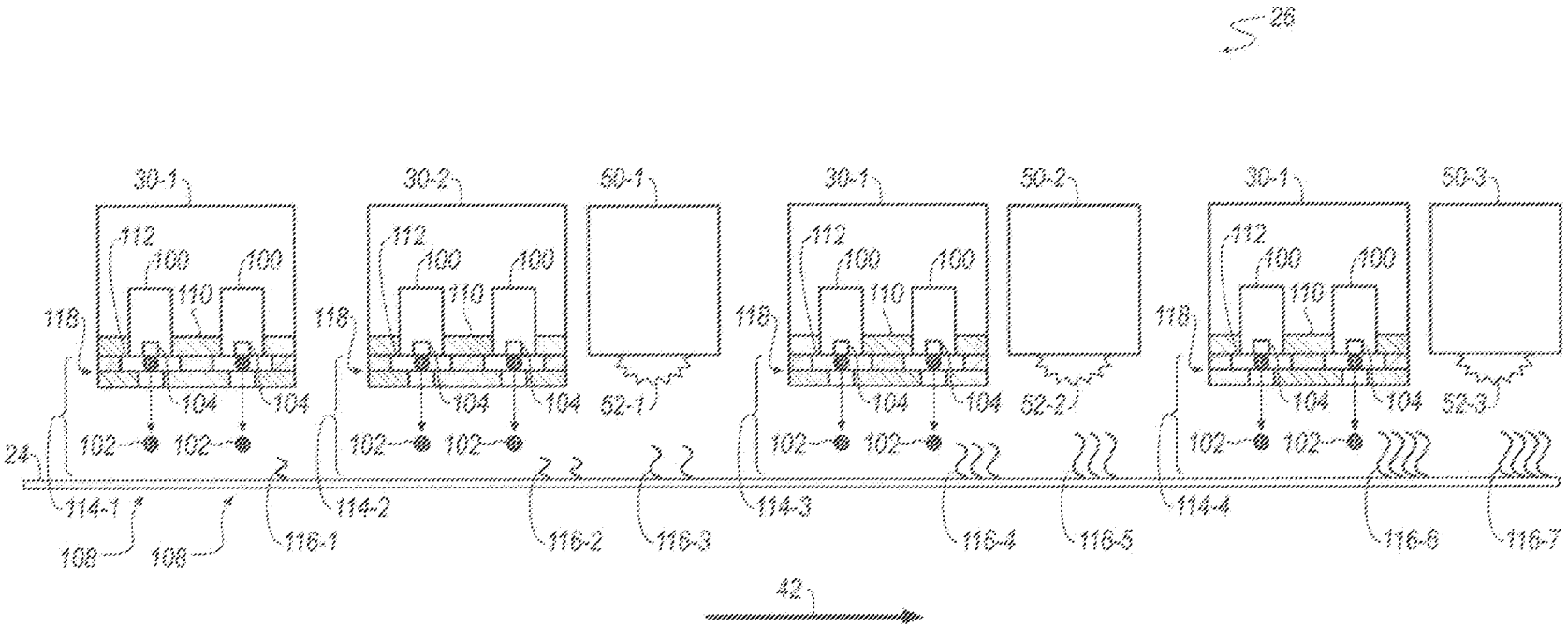
FIG. 4 provides, a schematic view of the embodiment of first print engine module of FIGS. 1-2 in greater detail.

FIG. 4 provides, a schematic view of the embodiment of first print engine module 26 of FIGS. 1-3 in greater detail. As is shown in FIG. 4, receiver 24 is moved past a series of inkjet printing modules 30-1, 30-2, 30-3, 30-4 which typically include a plurality of inkjet printheads 100 that are positioned by a support structure 110 such that a face 106 of each of the inkjet printheads 100 is positioned so nozzles 104 jet ink droplets 102 toward a target area 108. As used herein target area 108 includes any region into which ink droplets 102 jetted by an inkjet printhead 100 supported by a support structure are expected to land on a receiver to form picture elements of an inkjet printed image.

Inkjet printheads 100 can use any known form of inkjet technology to jet ink droplets 102. These can include but are not limited to drop on demand inkjet jetting technology (DOD) or continuous inkjet jetting technology (CIJ). In "drop-on-demand" (DOD) jetting, a pressurization actuator, for example, a thermal, piezoelectric, or electrostatic actuator causes ink drops to jet from a nozzle only when required. One commonly practiced drop-on-demand technology uses thermal actuation to eject ink drops from a nozzle. A heater, located at or near the nozzle, heats the ink sufficiently to boil, forming a vapor bubble that creates enough internal pressure to eject an ink drop. This form of inkjet is commonly termed "thermal ink jet (TIJ)."

In "continuous" ink jet (CIJ) jetting, a pressurized ink source is used to produce a continuous liquid jet stream of ink by forcing ink, under pressure, through a nozzle. The stream of ink is perturbed using a drop forming mechanism such that the liquid jet breaks up into drops of ink in a predictable manner. One continuous printing technology uses thermal stimulation of the liquid jet with a heater to form drops that eventually become print drops and non-print drops. Printing occurs by selectively deflecting one of the print drops and the non-print drops and catching the non-print drops. Various approaches for selectively deflecting drops have been developed including electrostatic deflection, air deflection, and thermal deflection. The inventions described herein are applicable to both types of printing technologies and to any other technologies that enable jetting of drops of an ink consistent with what is claimed herein. As such, inkjet printheads 100 are not limited to any particular jetting technology.

In the embodiment of FIGS. 2-5, inkjet printheads 100 of inkjet printing module 30-1 are located and aligned by a support structure 110. In this embodiment, support structure 110 is illustrated as being in the form of a plate having mountings 124 that are in the form of openings into which individual inkjet printheads 100 are mounted.

In the embodiments that are shown in FIGS. 2-4 dryers 50-1, 50-2, 50-3, are provided to apply heat to help dry receiver 24 by accelerating evaporation of carrier fluid in the inkjet ink. Dryers 50-1, 50-2, and 50-3 can take any of a variety of forms including, but not limited to dryers that use radiated energy such as radio frequency emissions, visible light, infrared light, microwave emissions, or other such radiated energy from conventional sources to heat the carrier fluid directly or to heat the receiver so that the receiver heats the carrier fluid. Dryers 50-1, 50-2, and 50-3 can also apply heated air to a printed receiver 24 to heat the carrier fluid. Dryers 50-1, 50-2, and 50-3 can also include exhaust ducts for removal of air including vaporized carrier fluid from the space under the dryers. In other embodiments, dryers 50-1, 50-2, and 50-3 can use heated surfaces such as heated rollers that support and heat receiver 24.

As ink droplets 102 are formed, travel to receiver 24, and dry, vaporized carrier fluid is introduced into the surrounding environment. This raises the concentration of vaporized carrier fluid 116 in a gap 114 between support structure 110 and target area 108. This effect is particularly acute in gaps 114 between the printer components (for example, printing modules 30 and dryers 50) and a target area 108 within which receiver 24 is positioned. To simplify the description, to the extent that terms such as moisture, humid, and humidity, may be used in this specification that in a proper sense relate only to water in either a liquid or gaseous form, these terms to refer to the corresponding liquid or gaseous phases of the solvents, carrier fluids, or any other jetted materials that make up a liquid portion of inkjet inks ejected as ink droplets 102 by inkjet printheads 100. When the ink is based on a solvent other than water, these terms are intended to refer to the liquid and gaseous forms of such solvents in a corresponding manner. In various embodiments herein ink droplets are generally referred to as delivering colorants to receiver 24 however, it will be appreciated that in alternate embodiments ink droplets can deliver other functional materials thereto including coating materials, protectants, conductive materials and the like.

During printing, inkjet printing modules such as inkjet printing module 30-1 rapidly form and jet ink droplets 102 onto receiver 24. This process adds vaporized carrier fluid to the air in gap 114-1, creating a first concentration of vaporized carrier fluid 116-1 and also increasing a risk of condensation on downstream portions of the support structure 110.

Further, as receiver 24 moves in the direction of travel 42 (left to right as shown in FIG. 4), warm humid air adjacent to receiver 24 is dragged along or entrained by the moving receiver 24. As a result, a convective current develops and causes the warm humid air to flow along direction of travel 42. When this happens, a substantial portion of the concentration of vaporized carrier fluid 116-1 in the air in a first gap 114-1 between nozzles 104 and target area 108 at inkjet printing module 30-1 travels with receiver 24 and enters a second gap 114-2 between nozzles 104 and target area 108 at inkjet printing module 30-2 where additional ink droplets 102 are emitted and add to the concentration of vaporized carrier fluid 116-1 to create a second carrier fluid concentration 116-2 that is greater than the first carrier fluid concentration 116-1.

Receiver 24 then passes beneath dryer 50-1 which applies energy 52-1 to heat receiver 24 and any ink thereon. The applied energy 52-1 accelerates the evaporation of the water or other carrier fluids in the ink. Although such dryers 50-1, 50-2, and 50-3 often include an exhaust system for removing the resulting warm humid air from above receiver 24, some warm air with vaporized carrier fluid can still be dragged along by moving receiver 24 as it leaves dryer 50-1. As a result, a third concentration of carrier fluid entering in third gap 114-3 between nozzles 104 and target area 108 at inkjet printing module 30-3 is greater than the second concentration of vaporized carrier fluid 116-2. Printing of ink droplets 102 at inkjet printing module 30-3 creates a fourth concentration of vaporized carrier fluid 116-4 exiting gap 114-3. To the extent that receiver 24 remains at an increased temperature after leaving dryer 50-1, carrier fluid from the ink can be caused to evaporate from receiver 24 at a faster rate further adding moisture into gap 114-3 such that the fourth concentration of vaporized carrier fluid 116-4 is found in gap 114-4 after receiver 24 has been moved past inkjet printing module 30-2 and dryer 50-1.

Accordingly, where multiple inkjet printing modules 30 jet ink onto receiver 24, vaporized carrier fluid concentrations near a receiver 24 can increase in like fashion cascading from a first level 116-1 to second level 116-2, to a third level 116-3 and so on up to a seventh, highest level 116-7 after dryer 50-3. As such, the risk of condensation related problems increases with each additional printing undertaken by inkjet printing modules 30-2, 30-3, and 30-4 downstream of dryer 50-1 it is necessary to reduce the risk that these concentrations will cause condensation that damages the printer or the printed output. Multi-Zone Condensation Control.

Figure 5:
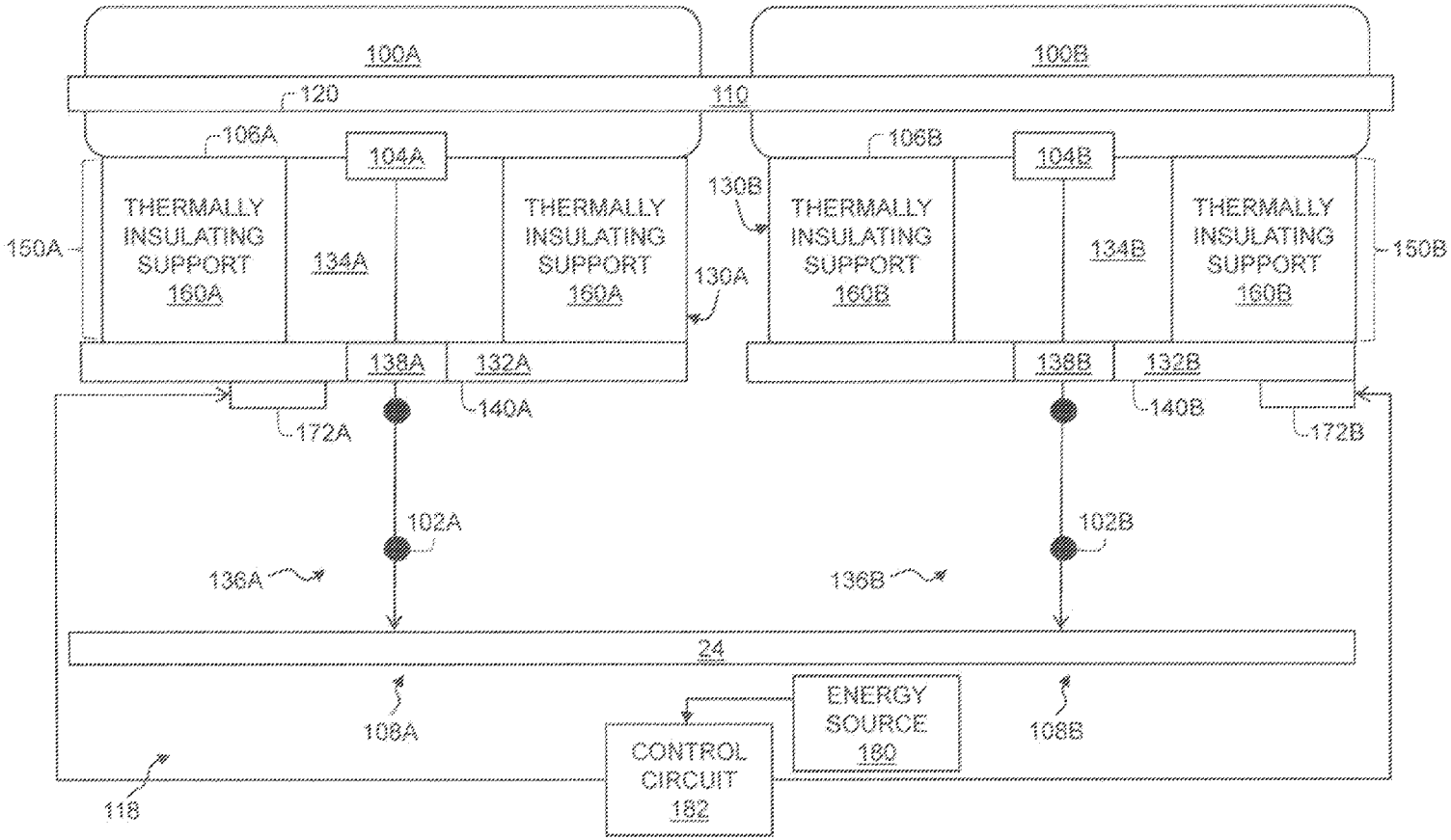
FIG. 5 shows a first embodiment of an apparatus for controlling condensation in an inkjet printing system.

As is shown in outline in FIG. 4 and in detail in FIG. 5, inkjet printing system 20 has a condensation control system 118 that in this embodiment provides a cap 130 for each of the printheads 100. Each cap 130 has a shield 132 and thermally insulating separators 160. An energy source 180 provides energy that can be applied to cause the shields to be heated and a control circuit 182 control an amount of energy that can be applied individually to heat each shield 132 an inkjet printing module 30.

In the embodiment of FIG. 5, two printheads, shown as first printhead 100A and second printhead 100B, are illustrated. A first shield 132A is positioned between first print head 100A and a first target area 108A. This creates a first shielded region 134A between a face 106A of first printhead 106A and shield 132A and a first printing region 136A between first shield 132A and a first target area 108A through which receiver transport system 40 moves receiver 24 during printing. A second shield 132B is positioned between second print head 100B and a second target area 108B. This creates a second shielded region 134B between a face 106B of second printhead 100B and shield 132B and a second printing region 13613 between second shield 132B and a second target area 108B through which receiver transport system 40 also moves receiver 24 during printing.

First shield 132A and second shield 132B are non-porous and serve to prevent condensation from accumulating on faces 106A and 106B of inkjet printheads 100A and 100B. Shields 132A and 132B also provide some protection from physical damage to inkjet printheads 100 and support structure 110 that might be caused by an impact of receiver 24 against a face 106A of printhead 100A, against a face 106B of printhead 100B or against support structure 110. First shield 132A and second shield 132B can take the form of plates or foils and films.

Generally, shields 132A and 132B span at least a width dimension and a length dimension over nozzles 104A and 104B of printheads 100A and 100B. Shields 132A and 132B therefore provide surface area that is relatively large compared to a small thickness that is, for example, on the order of about 0.3 mm. In other embodiments, first shield 132A and second shield 132B can have a thickness in the range of about 0.1 mm to 1 mm.

Accordingly, shields 132A and 132B can have a low heat capacity so that a temperature of shields 132A and 132B will rise or fall rapidly and in a generally uniform manner when heated or otherwise exposed to energy from an energy source and otherwise will act to rapidly approach an ambient temperature. In certain circumstances this ambient temperature will be below a condensation temperature of the vaporizable carrier fluid in printing regions 136A and 134B. This creates a risk that condensation will form on shields 132A and 132B.

Accordingly, shields 132A and 132B are actively heated so that they remain at a temperature that is at or above the condensation temperature of the vaporized carrier fluid in printing regions 136A and 136B. Increasing the temperature of shield 132 reduces or prevents condensation from forming and accumulating on a face 140 of shield 132 that faces target area 108.

In the embodiment of FIGS. 2-5 shield 132 is made of a material having a high thermal conductivity, such as aluminum or copper. The high thermal conductivity of such an embodiment of shield 132 helps to distribute heat more uniformly across shield 132 so that the temperature of shield 132 maintains a generally uniform temperature and avoids the formation of localized regions of lower temperature that may enable the formation of condensation. Optionally shield 132 can be made from a non-corrosive material such as a stainless steel.

Additionally, in this embodiment, shields 132 can have a higher emissivity (e.g., greater than 0.75) to better absorb thermal energy. For example, shields 132 can preferably anodized black in color. Alternatively, shield 132 can be another dark color. Absorption of the thermal energy radiating onto shield 132 can passively increase the temperature of shield 132 to reduce an amount of energy required to actively heat the shields 132 above the condensation temperature of vaporized carrier fluid in printing regions 136 associated therewith.

In other embodiments shield 132 can be made of a material having a lower thermal conductivity, such as for example, other metal materials and ceramic materials. In still other embodiments, shield 132 can be made from any of a stainless steel, a polyamide, polyimide, polyester, vinyl and polystyrene, and polyethylene terephthalate.

As is illustrated in FIG. 4, shield 132A has an opening 138A through which nozzles 104A can jet ink droplets 102A to target area 108A and shield 132B has an opening 138B through which nozzles 104B can jet ink droplets 102B to target area 108B.

Figure 6:
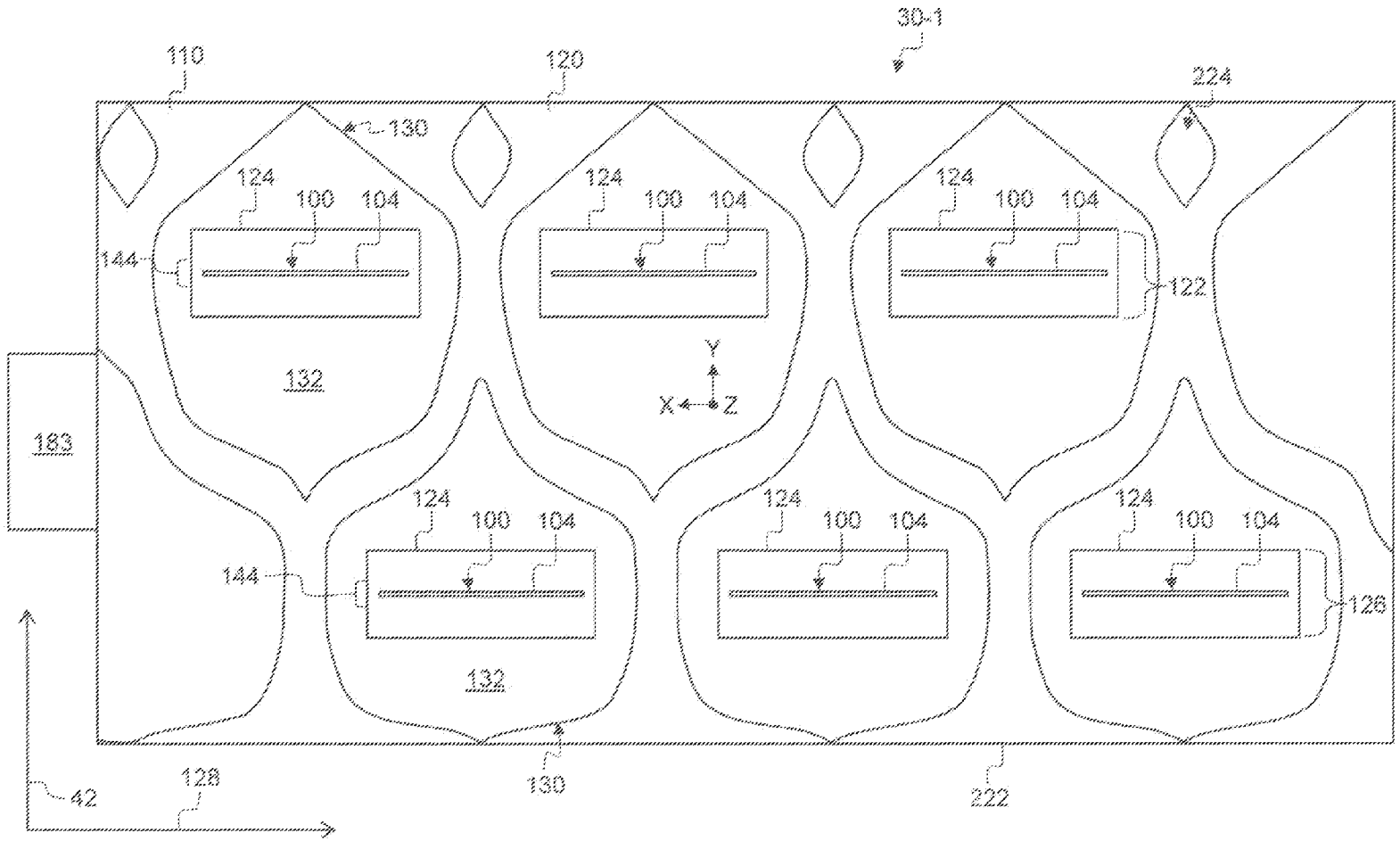
FIGS. 6 and 7 respectively illustrate a face 120 of support structure 110 and a face of a corresponding shield 132 that confront a target area 108.
Figure 7:
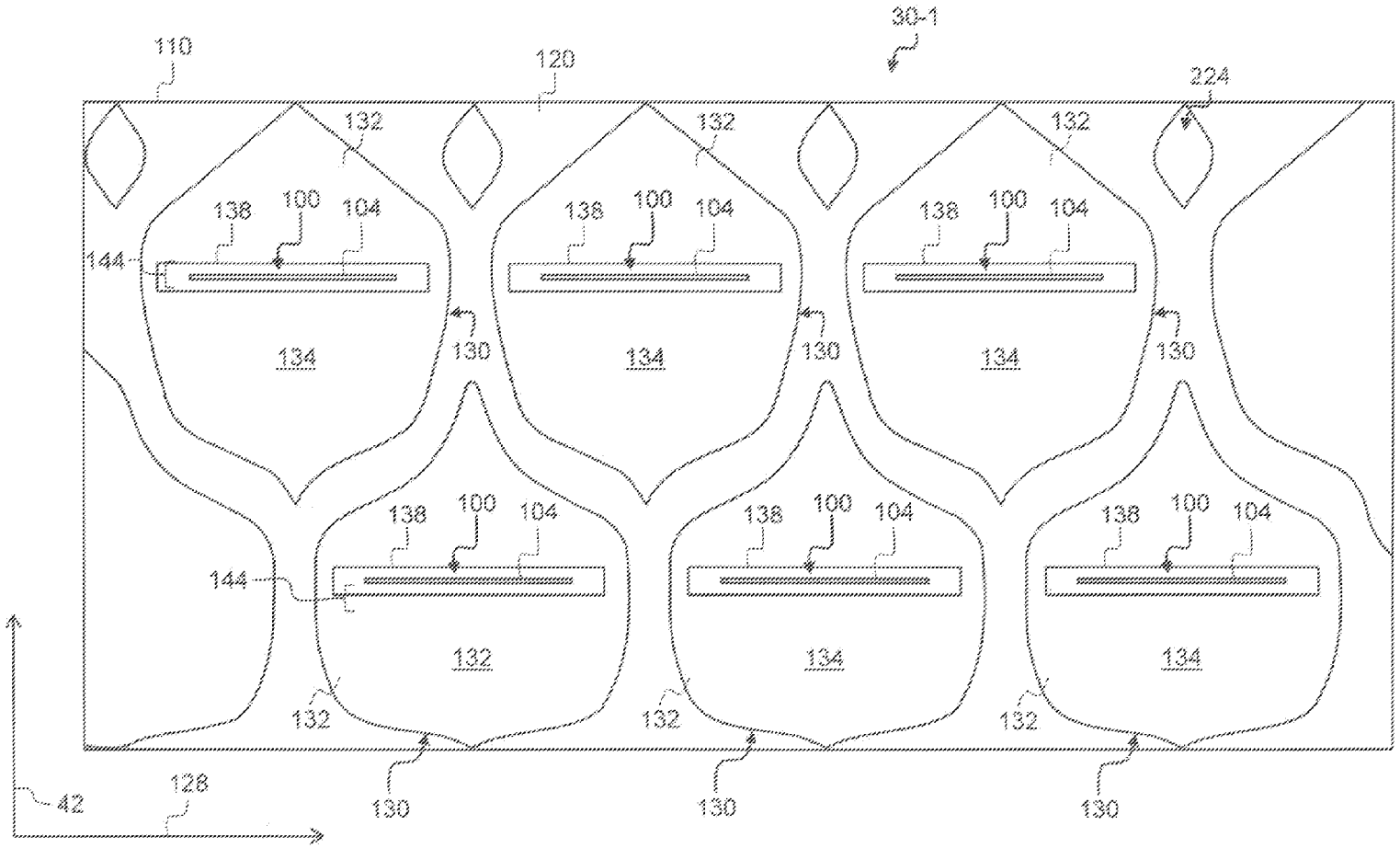

In one embodiment, openings 138A and 138B can be shaped or patterned to correspond to an arrangement of nozzles 104A and 104B in an inkjet printing module such as inkjet printing module 30-1. One example of this type is illustrated in FIGS. 6 and 7 which respectively illustrate a face 120 of support structure 110 and a face of a corresponding shield 132 of cap 130 that confront a target area 108. As is shown in this embodiment, support structure 110 has a first row 122 with a plurality of mountings 124 that in this embodiment extend through a thickness of support structure 110 each aligned with a linear array of nozzles 104 on a face 106 of inkjet printhead 100. Mountings 124 are in a spaced arrangement along a width axis 128 that is normal to a direction of travel 42 of receiver 24 past inkjet printing module 30-1. Support structure 110 also has a second row 126 with a plurality of mountings 124 also spaced from each other and distributed laterally across a width axis 128. Each opening has an inkjet printhead 100 therein with a linear array of nozzles 104. As can be seen from FIG. 6, the arrangement of mountings 124 in first row 122 is offset from the arrangement of mountings 124 in second row 126 to position linear arrays of nozzles 104 such that each inkjet printhead 100 can eject ink droplets (not shown) across a continuous range of positions 146 along width axis 128.

FIG. 7 shows a view of faces 140 of shields 132 of caps 130 placed over the support structure 110 and printheads 100 illustrated in FIG. 6, also from the perspective of target area 108. As is shown in FIG. 7, shields 132 each have an opening 138 that provide a path for inkjet drops (not shown) that are ejected from the linear arrays of nozzles 104 to pass through shield 132. As can be seen from FIG. 7, openings 138 partially cover inkjet printheads 100 while still providing openings that have a minimum cross-sectional distance to allow ink droplets to pass there through without interference.

In the embodiment of FIG. 7, openings 138 are sized and shaped to help to limit the extent to which vaporized carrier fluid can reach shielded regions 134 from printing regions 136 while not interfering with the transit of ink droplets 102 through openings 138. In one embodiment, this is done by providing that openings 138 have a size in a smallest cross-sectional distance 144 that is limited to limit the extent to which vaporized carrier fluid concentrations from printing regions 136 can reach shielded regions 134. In this example, openings 138 shown in FIG. 7 extend for a comparatively long distance in one cross sectional distance along width axis 128. However, openings 138 extend only a short distance along the direction of travel 42 causing the smallest cross-sectional distance 144 to be along direction of travel 42. In one embodiment, the smallest cross-sectional distance 144 is limited, interposing shield 132 between substantial amount of a surface area of face 120 support structure 110 as well as a substantial portion of a surface area of each of the faces 106 of inkjet printheads 100.

In one embodiment, the smallest cross-sectional distance 144 of an opening is defined as a function of a size of an ink droplet 102 such as 150 times the size of an average weighted diameter of ink droplets 102 ejected by an inkjet printhead 100. For example, in one embodiment, the smallest distance can be on the order of less than 300 times an average diameter of inkjet droplets while in other embodiments, the smallest cross-sectional distance of an opening 138 can be on the order of less than 150 times the average diameter of inkjet droplets 102 and, in still other embodiments, the smallest cross-sectional distance of an opening 138 can be on the order of about 25 to 70 times the average diameter of a diameter of inkjet droplets.

In other embodiments, a smallest cross-sectional distance 144 of an opening 138 can be determined based upon the expected flight envelope of ink droplets 102 as inkjet droplets were to travel from nozzles 104 to target area 108. That is, it will be expected that ink droplets 102 will travel nominally along a flight path from nozzles 104 to target area 108 and that there will be some variation in flight path of any individual inkjet drop relative to the nominal flight path and that the expected range of variation can be predicted or determined experimentally and can be used to define the smallest cross-sectional area of the smallest cross-sectional distance 144 of one or more opening 138 such that an opening 138 has a smallest cross-sectional distance that does not interfere with the flight of any inkjet droplet from a nozzle 104 to a target area 108.

Returning now to FIG. 5, shields 132 are positioned at a separation distances 150A and 150B from faces 106A and 106B using thermally insulating separators 160A and 160B. In the embodiment that is shown in FIG. 5, thermally insulating separators 160 are in contact with faces 106A and 106B and are used to hold shield 132 in fixed relation to faces 106A and 106B. Thermally insulating separators 160A and 160B can alternatively be joined to join support structure 110. Thermally insulating separators 160A and 160 B can be joined to shields 132A and 132B in any of a variety of ways, including but not limited to the use of conventional mechanical fasteners, adhesives, magnetic attraction. Thermally insulating separators 160A and 160B can be permanently fixed to faces 106A and 106B, to support structure 110 or to shields 132A and 132B. Conversely thermally insulating separators 160A and 160B can be removably mounted to faces 106A and 106B, to support structure 110 or to shields 132A and 132B. For example, in one embodiment, thermally insulating separator 160 can take the form of a thin layer of a magnetic material that is joined to selected regions of shield 132. In other embodiments, shield 132 is positioned between the support structure 110 and target area 108 by a plurality of thermally insulating separators 160. Such a plurality of thermally insulating separators 160 can take the form of pins, bolts, or other forms of connectors.

Thermally insulating separators 160A and 160E can be made to be thermally insulating through the use of thermally insulating materials including but not limited to air or other gasses, Bakelite, silicone, ceramics or an aerogel based material. Thermally insulating separator 160 can also be made to be thermally insulating by virtue a shape or configuration, such as by forming thermally insulating separators 160A and 160*b* through the use of a tubular construction. In one embodiment of this type, a poor thermal insulator such as stainless steel can be made to act as a thermal insulator by virtue of assembling the stainless steel in a tubular fashion. Optionally, both approaches can be used.

Thermally insulating separators 160A and 160B can have a fixed size or can vary with temperature. In one embodiment, a thermally insulating separator 160 is thermally expansive so that thermal insulator expands the separation between shield 132 and support structure 110 when the temperature of a shield 132 increases.

It will be appreciated that separation distances 150A and 150B create a shielded regions 134A and 134B that provide an air gap between faces 106A and 106B and shields 132A and 132B. In this way, shields 132A and 132B are thermally insulated from faces 106A and 106B to allow shields 132A and 13B can have a temperature that is greater than a temperature of faces 106A and 106B without heating inkjet printheads 100 to an unacceptable level. While an air gap between the faces 106 and the shields 132 is desirable to provide thermal insulation, the air gap does not need to be large. To keep the flight path from the printhead to the target region small, which is desired for maintaining the best print quality, the air gap should be kept small. In one preferred embodiment, the air gap in approximately 0.1 mm tall.

The thermal insulation provided by the air gap in turn allows shields 132A and 132B to be actively heated to a temperature that is above a condensation point for the vaporized carrier fluids in printing regions 136A and 136B while allowing inkjet printheads 100 to remain at cooler temperatures, including, in some embodiments, temperatures that are below a condensation temperature of the vaporized carrier fluids in printing regions 136B.

It will be appreciated however that the condensation temperature in a first printing region 136A can differ significantly from the condensation temperature in a second printing region 1326B. This can occur for a variety of reasons. For example, first printing region 136A and second printing region 136B can have different in concentrations of vaporized carrier fluid, temperatures, heating or cooling rates, printing loads, printhead temperatures, and different exposure to factors such as ambient humidity, airflow, receiver temperature, printhead temperature, variations in an amount of ink used for printing. These conditions can also change rapidly and dynamically across a plurality of printheads in the printing module.

Accordingly, in the embodiment illustrated in FIG. 5, an energy source 180 and a control circuit 182 are provided respectively to make energy available that can be used to heat shields 132A and 132B to heat and to control the extent to which each the available energy is supplied to the shield 132A and to 132B so that shields 132A and 132B can be heated to different temperatures. This allows condensation to be controlled while also limiting the risk of overheating or underheating.

There are a number of ways in which this can be done. In one embodiment, energy source 180 supplies electrical energy and control circuit 182 includes logic circuits that determine an extent to which electrical energy is supplied to a first electrical heater 172A that causes the first shield 132A to heat and a second electrical heater 172B that causes the second shield to heat and power control circuits 182 that control the transfer of electrical energy to first electrical heater 172A and that separately control the transfer of electrical energy to second electrical heater 172B. In one embodiment, electrical heaters 172A and 172B are in the form of resistors or other known circuits or systems devices that convert electrical energy into heat. In certain embodiments, electrical heaters 172A and 17213 can comprise a thermoelectric heat pump or "Peltier Device" that pumps heat from one side of the device to another side of the device. Such a thermoelectric heat pump can be arranged to pump heat from a side 142 of shield 132 confronting first region 136 to a side in contact with shield 132. Such electrical heaters 172A and 172B can be joined to shields 132A and 132B or shields 132A and 132B can be made from a material or comprise a substrate that can heat in response to applied electrical energy.

In a further embodiment, the energy source 180 can comprise a heater that heats a plurality of contact surfaces that are in contact with shields 132A and 132B and control circuit 182 can control an actuator such as a motor that controls an extent of contact between the shields and the contact surface or can control an amount of heat supplied by the energy source to each of the contact surface.

It will be appreciated that in other embodiments, shields 132 can be attached to printheads 100 as shown in FIG. 5, or alternatively, shields 132 can be attached to the support structure 110 adjacent to printhead 100. Attachment of shields 100 to the printheads enables the use of smaller shields 132. Attachment of shields 132 to the support structure 110 can allow smaller separation distances between faces 106 of printheads 100 and shields 132 as the support structure 110 mounting point can be recessed relative to the faces 106 of the printheads 100. It also enables printheads 100 to be more thermal isolated from the shield 132.

Figure 8:
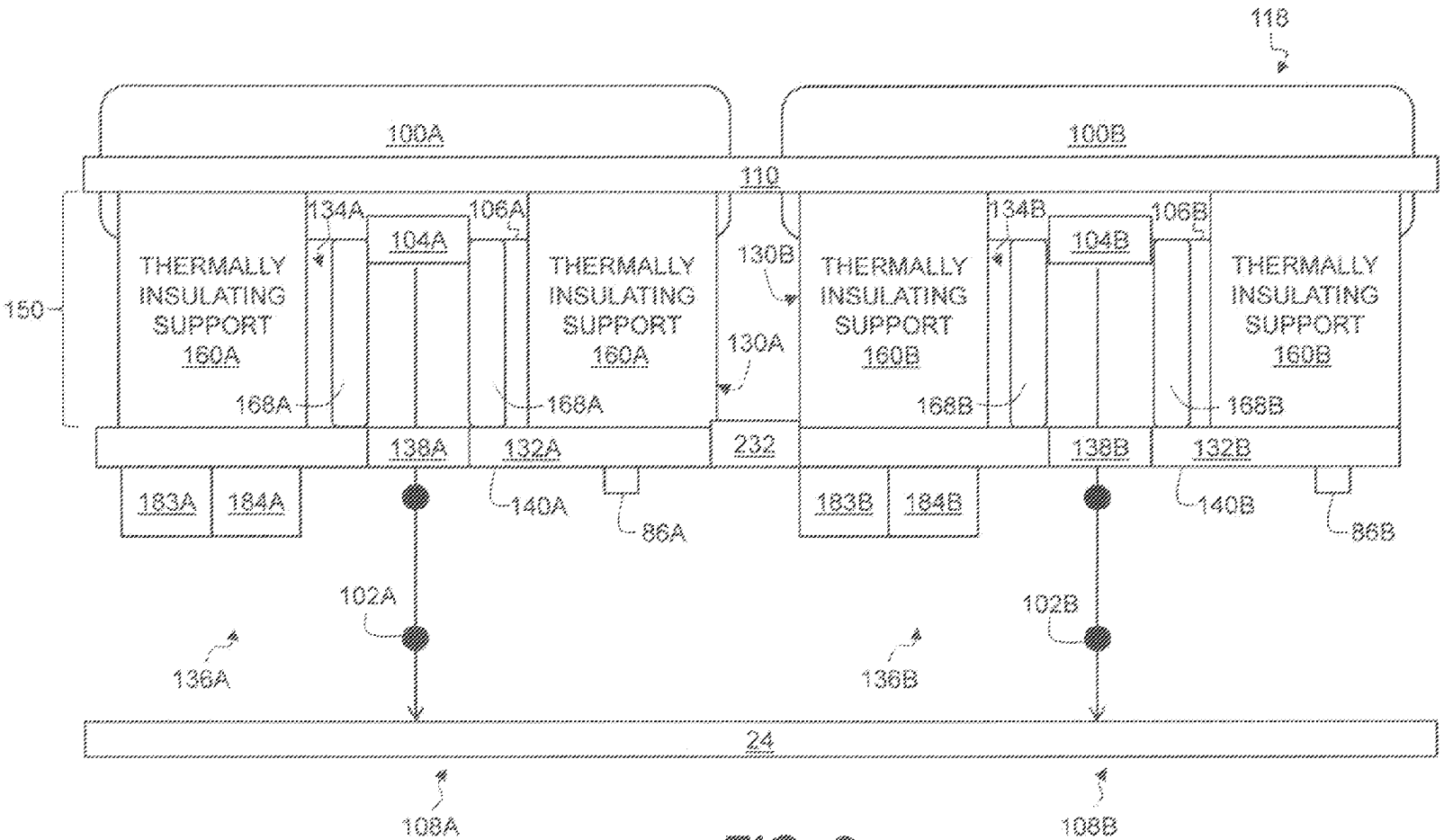
FIG. 8 shows another embodiment of a condensation control system of an inkjet printing system.

FIG. 8 illustrates another embodiment of an energy source 180 (shown in FIG. 5) and control circuit 182 (shown in FIG. 5). In this embodiment energy source 180 provides separate flows of a heated medium that contact different ones of the shields and that heat different ones of the shield. In this embodiment, control circuit 182 controls the extent of each separate flow in order to control the heating of the separate shields. For example, as is shown in FIG. 8, energy source 180 supplies energy to a first heater 183A that heats air or another gas that is fed into printing regions 136A by a blower 184 to heat both ink droplets 102 and first shield 132A as well as a second heater 183B that heats air or another gas that is fed into printing regions 134B by a second blower 184B. It will be appreciated that the amount of gas fed in this manner will be limited so as not to disturb the travel of ink droplets 102. A separator 186 is positioned between first printing region 136A and second printing region 136B and can include a vacuum return to draw heated gasses as well as a portion of vaporized carrier fluid in first printing region 136A and a portion of vaporized carrier fluid in second printing region 134B from printhead 100A and 100B. Control circuit 182 can control the extent of the flows of heated air caused by these systems by way of controlling an amount of energy supplied to first blower 184A and second blower 184B.

Any other known mechanism and control system that can be combined to permit controlled heating of adjacent but thermally isolated surfaces can be used toward this end. Control circuit 182 can take any of a variety of forms of control circuits known in the art for controlling energy supplied to heating elements. In one embodiment, printer controller 82 can be the control circuit. In other embodiments, control circuit 182 can take the form of a programmable logic executing device, a micro-processor, a programmable analog device, a micro-controller or a hardwired combination of circuits made cause printing system 20 and any components thereof to perform in the manner that is described herein.

The heating of shields 132A and 132B can be uniform or patterned. In one embodiment of this type, a heater 172 can take the form of a material that heats when electrical energy is applied and that is patterned to absorb applied energy so that different portions of shield 132 heat more than other portions in response to applied energy. This can be done for example, and without limitation, by controlled arrangement or patterning of heaters 172 or shields 132A and 132B. Such non-uniform heating of shields 132A and 132B can be used for a variety of purposes. In one embodiment, shields 132 can be adapted to heat to a higher temperature away from respective openings 138 than proximate to openings 138.

It will be appreciated from the forgoing that portions of shield 132A and 132B are located between portions of the face of the printheads and the target area to limit the extent to which vaporized carrier fluid passes from printing regions 136A and 136B to shielded regions 134A and 134B. In certain embodiments, this also advantageously limits the extent to which any radiated energy can directly impinge upon the faces 106A and 106B of the printheads 100A and 100B. In the embodiment illustrated in FIG. 8, heating of first printing region 136A and second printing area 136B is controlled through a feedback system in which control circuit 182 uses signals from sensors 86A and 86B to detect conditions in printing regions 136A and 136B as a basis for generating signals that control an amount of energy supplied by energy source 180 so as to dynamically control the heating of shield 132. FIG. 8 illustrates one embodiment of this type having sensor 86A and 86B positioned in printing regions 136A and 136B and operable to generate a signal that is indicative of as a ratio of the partial pressure of carrier fluid vapor in an air-carrier fluid mixture in printing regions 136A and 136B to the saturated vapor pressure of a flat sheet of pure carrier fluid at the pressure and temperature of printing regions 136A and 136B. The signals from sensor 86A and 86B are transmitted to control circuit 182. Control circuit 182 then controls an amount of energy supplied by the energy source 180 to heat the shields 132A and 132B according to the relative humidity in the printing regions 136A and 136B.

In another embodiment, sensors 86A and 86B can comprise a liquid condensation sensor located proximate to shields 132A and 132B and that are operable to detect condensation on faces 140A and 140B of shields 132A and 132B. Sensors 86A and 86B are further operable to generate a signal that is indicative of the liquid condensation, if any, that is sensed thereby. The signals from sensors 86A and 86B is transmitted to control circuit such as printer controller 82 so that printer controller 82 can control an amount of energy supplied by energy source 180 to cause shields 132A and 132B to heat according to the sensed condensation.

In still another embodiment, sensors 86A and 86B can comprise temperature sensors located proximate to shields 132A and 132B operable to detect a temperature of shields 132A and 132B facing and further operable to generate a signal that is indicative of the temperature of shield 132. The signal from sensor 86 is transmitted to control circuit such as printer controller 82 so that control circuit 182 can control an amount of energy supplied by energy source 180 to cause shields 132A and 13213 to heat according to the sensed temperature.

In yet another embodiment, sensors 86A and 86B can comprise receiver temperature sensors that are operable to detect conditions that are indicative of a temperature of receiver 24 such as an intensity of infra-red light emitted by receiver 24 and further operable to generate a signal that is indicative of temperature of receiver 24. The signal from sensor 86 is transmitted to control circuit 182 so that control circuit can control an amount of energy supplied by energy source 180 to cause shields 132A and 132B to heat according to the sensed temperature of receiver 24 when receiver 24 is in first printing region 136A and in second printing area 136B.

As is shown in the embodiment of FIG. 8, shield 132 can have optional seals 168 to seal between shield 132 and at least one of support structure 110 and face 106 of printheads 100. Seals 168 can be located to further restrict the transport of vaporized carrier fluid near printhead 100 and support structure 110 and can be positioned along a perimeter of a shield 132, and also around the perimeter of the opening 138. By sealing around the edges of the shield, air flow through the air gap is restricted, which enhances the thermal insulation value of the air gap. Such seals 168 should also be provided in the form of thermal insulators and in that regard, in one embodiment the thermally insulating separator 160 can be arranged to provide a sealing function.

Figure 9:
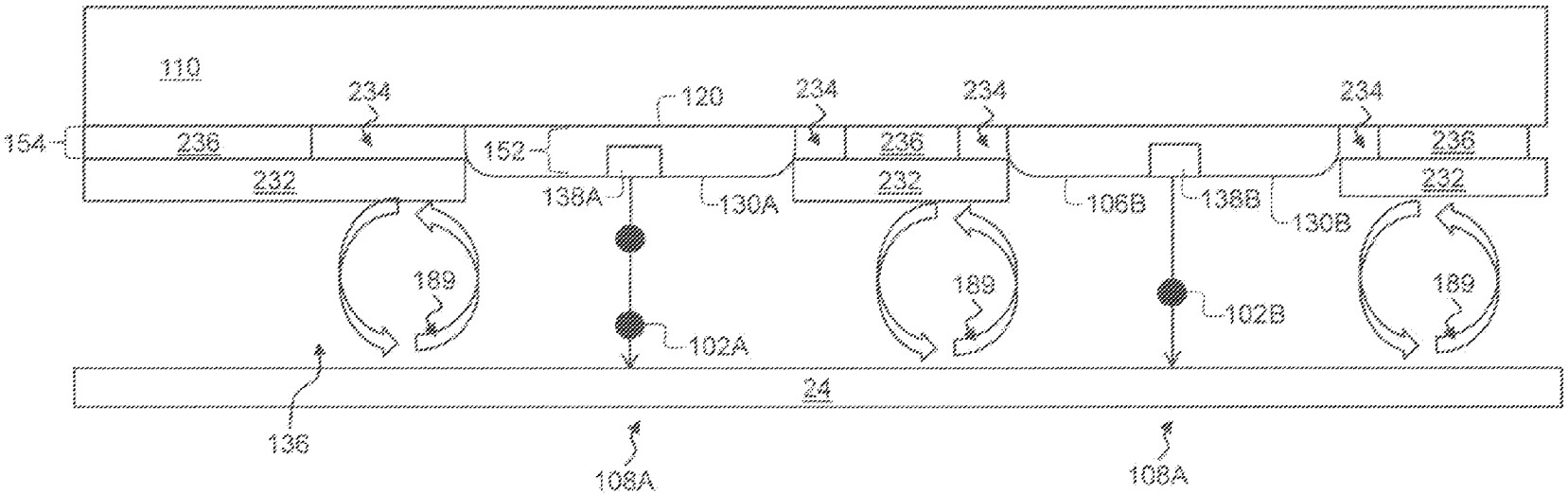
FIGS. 9, 10 and 11 illustrate another embodiment of a condensation control system for an inkjet printing system.

FIG. 9 illustrates another embodiment of a condensation control system 118 (shown in FIG. 4) for an inkjet printer 20. In this embodiment, caps 130A and 130B have sides 140A and 140B (both shown in FIG. 5) of shields 132A and 132B apart from face 120 of support structure 110 by a projection distance 152. As is also shown in FIG. 9, an optional a supplemental shield 232 is positioned apart from face 120 by thermally insulating separators 236. This creates an insulating area 234 between supplemental shield 232 and face 120. In one embodiment, air or another medium can be passed through insulating area 234 to prevent condensate build up and to reduce temperatures.

In the embodiment that is illustrated, supplemental shield 234 is positioned apart from face 120 by separation distance 154 that is less than the projection distance 152 of caps 130. Preferably, supplemental shield 232 is sealed or substantially sealed against caps 130A and 130B to protect against carrier fluid vapor reaching support structure 110. Supplemental shield 232 can be heated by convection flows of air 189 heated by receiver 24 to an elevated temperature. This can reduce the possibility that vaporized carrier fluids will condense against supplemental shield 232. Optionally supplemental shield 232 can be actively heated in any of the manners that are described herein. Optional supplemental shield 232 can also be made in the same fashion and from the same materials and construction as shields 132A and 132B.

Figure 10:
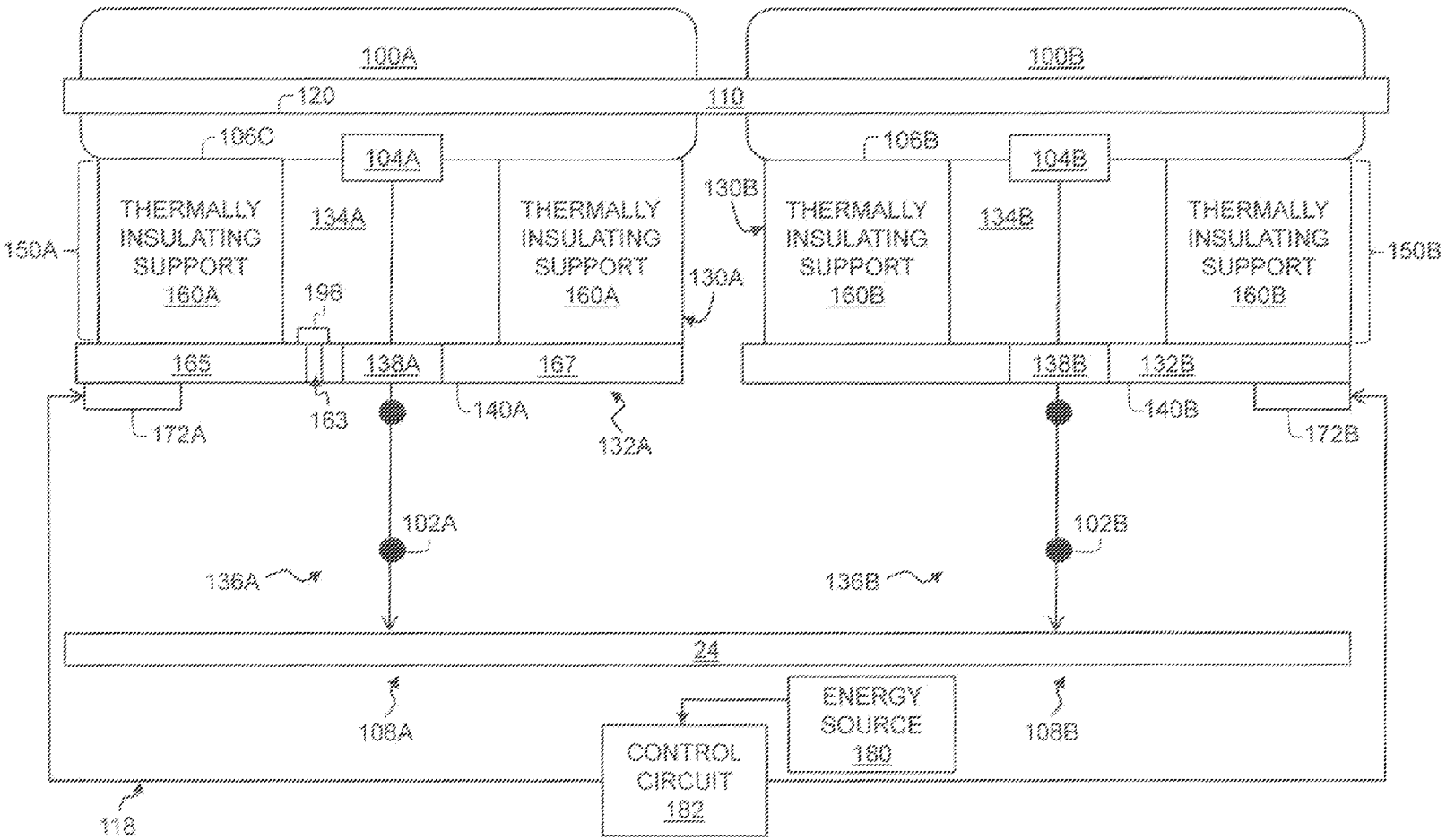

FIG. 10 shows another embodiment of a condensation control system 118 for an inkjet printing system 20. As is shown in this embodiment, condensation control system 118 has a multi-part shield arrangement with first shield 132A being provided in the form of multiple parts, a first part 165 of first shield 132A supported by a first part 165 of thermally insulating separator 160A and a second part 167 of first shield 132A supported by a second part of thermally insulating separator 160A. The different shield parts 165 and 167 can have corresponding or different responses to energy and can be controlled by a common control signal or a shared energy supply or by individual control signals or energy supplies.

In the embodiment that is illustrated in FIG. 10, parts 165 and 167 are optionally linked by way of an expansion joint 163 that allows shield parts 165 and 167 to expand and to contract with changes in temperature without creating significant stresses at thermally insulating separator 160A or thermally insulating separator 160B and without creating an opening therebetween to allow vaporized carrier fluid into such an opening. Here expansion joint 163 is illustrated generally as an expandable material 169 linking first part 165 and second part 167 in a manner that maintains a seal between the parts. In one embodiment of this type expansion joint 165 comprises a stretchable tape that allows first part 165 and second part 167 to move relative to each other while maintaining a seal. In still another embodiment, shield 132 can comprise a flexible or bendable sheet that is held in tension by the thermally insulating separator 160 with the thermally insulating separator 160 acting as a frame. In a further embodiment shield 132 can be stretchable to accommodate changes in dimension of the support structure 110 or inkjet printheads 100 due to heating or cooling.

Figure 11:
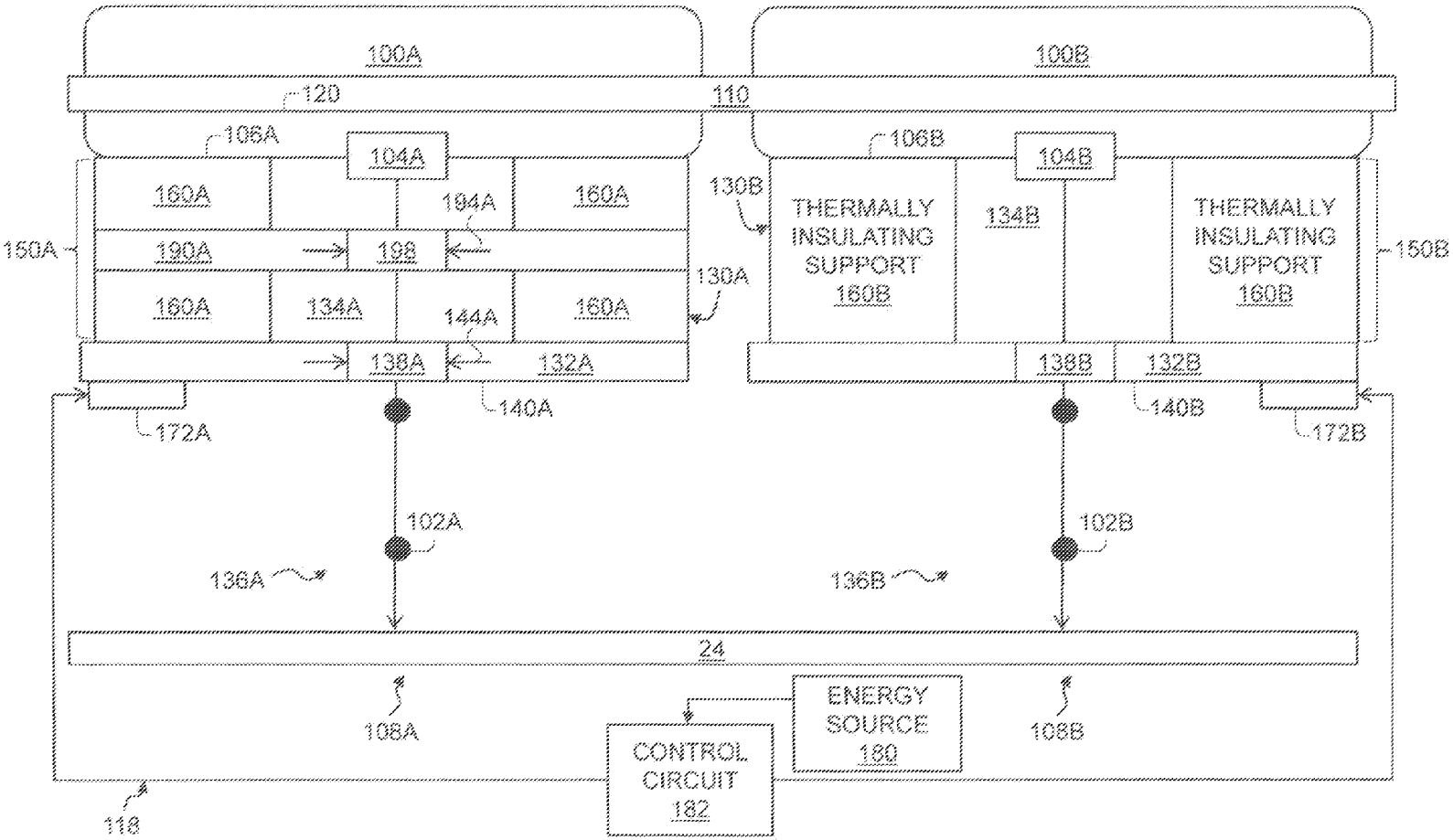

FIG. 11 shows another embodiment of a condensation control system for an inkjet printing system 20. As is shown in this embodiment, condensation control system 118 has an a first cap 130A with an intermediate shield 190A to define an intermediate region 196A joined to first region 134A by way of an intermediate opening 198 through which ink droplets 102 can be jetted. The intermediate shield 190A has an intermediate opening 198A. In one embodiment, intermediate opening 198A can match opening 138 such as by having a smallest dimension 194 for intermediate opening 198 that is substantially similar to a smallest cross-sectional distance 144 of opening 138 in shield 132. Alternatively, the shapes and sizes of intermediate openings 198A in intermediate shield 190A can have a different size or shape of openings 138A in first shield 132A. In one embodiment, the one or more intermediate openings 198 can be shaped or patterned to correspond to an arrangement of nozzles 104 in an inkjet printing module such as inkjet printing module 30-1. The intermediate opening 198 in intermediate shield 190 also can be defined independent of the opening 138 in shield 132 in the same manner as described above. Intermediate shield 190A divides first shielded region 134A into two parts to further reduce airflow between printhead 100 and printing area 134A and can also be used to provide additional heat shielding.

Figure 12:
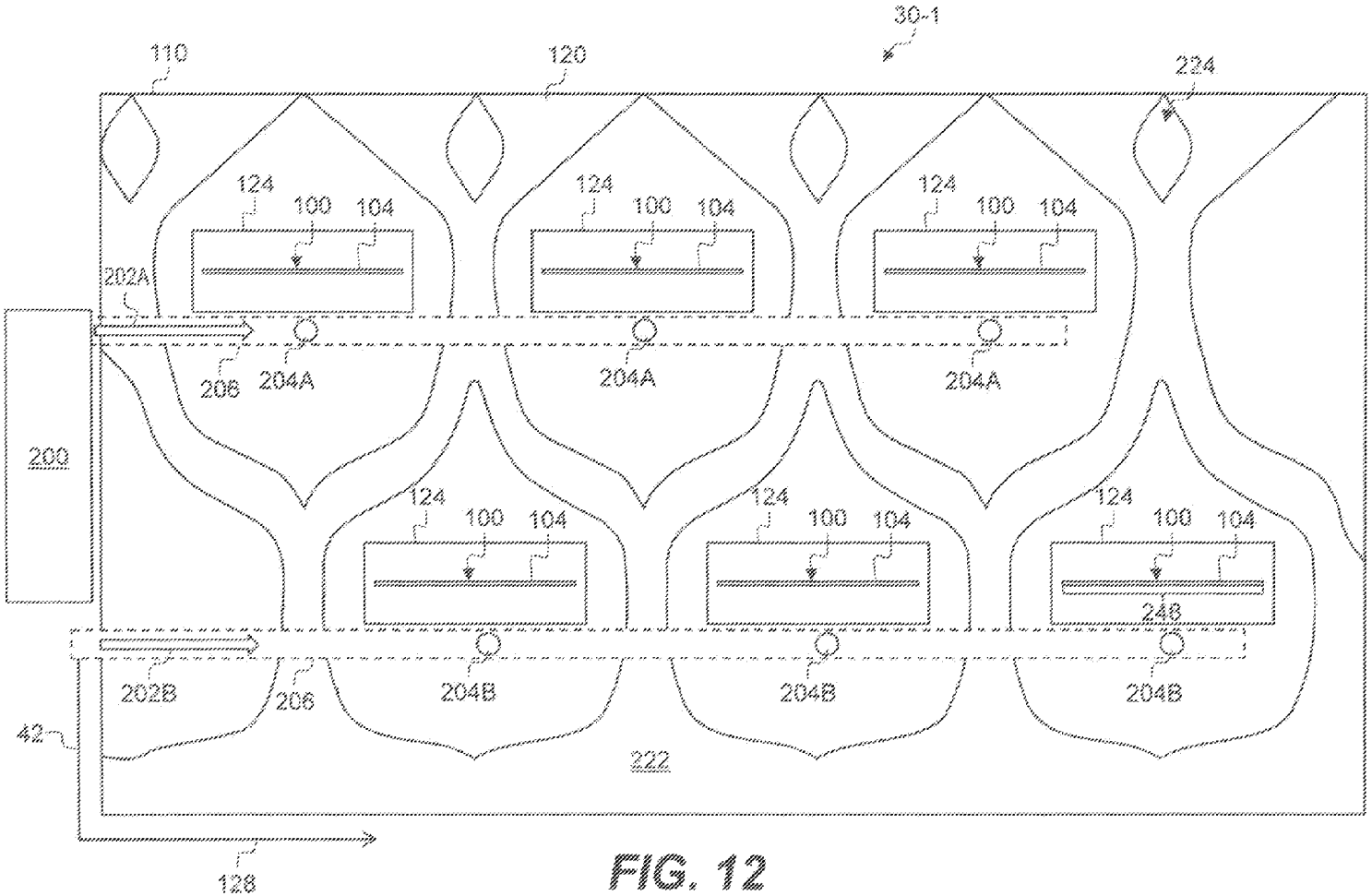
FIGS. 12 and 13 show a further embodiment of a condensation control system for an inkjet printing system.
Figure 13:
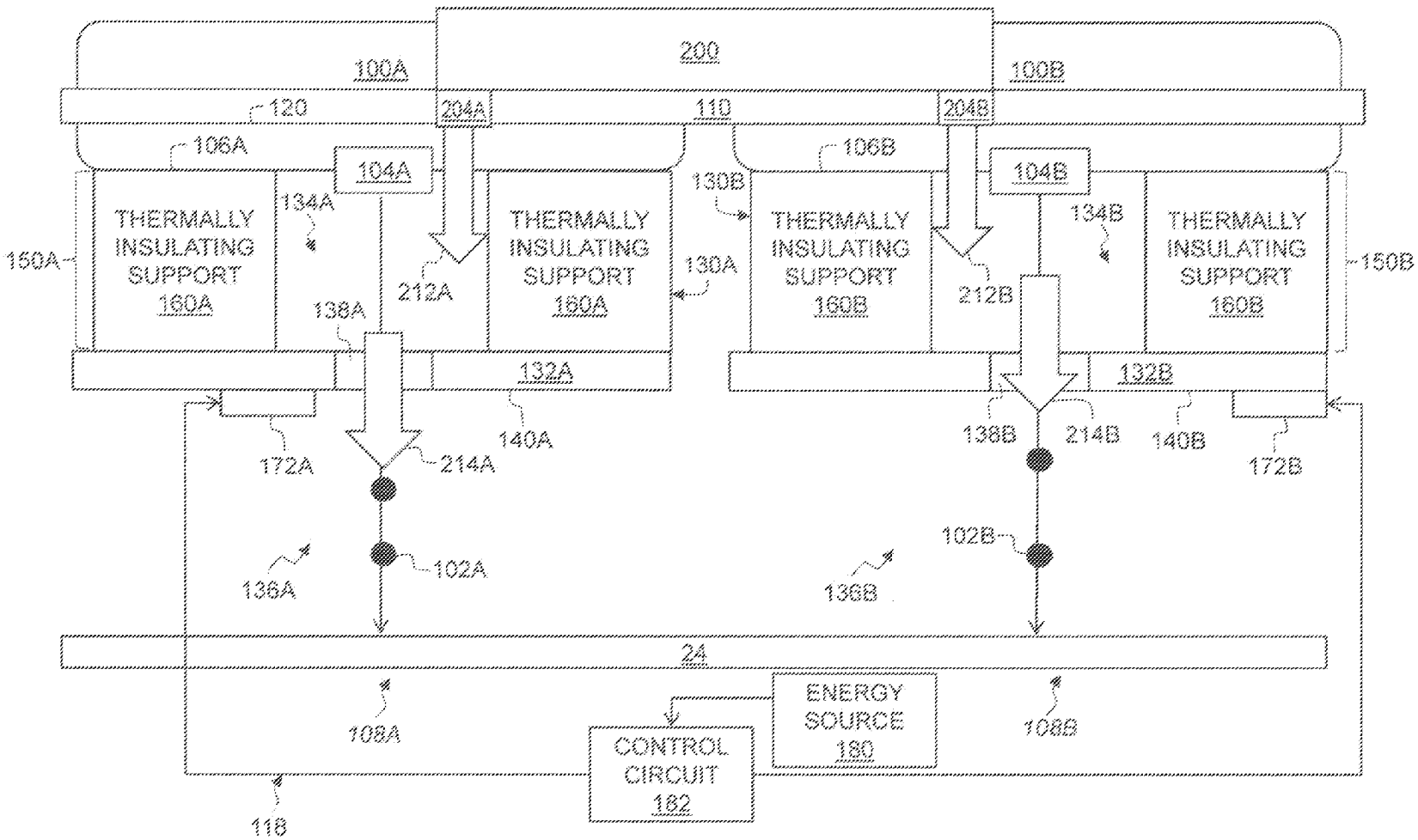

FIGS. 12 and 13 illustrate another embodiment of a condensation control system for an inkjet printing system. As is shown in FIG. 12, in this embodiment, support structure 110 provides an opening 204 proximate to each of the mountings 124 for printheads 100. Opening 202 is connected by way of a manifold or other appropriate ductwork 206 (shown in phantom) to a cap blower 200 which is controlled by control circuit 182.

As is shown in FIG. 13, in operation, cap blower 200 creates flows 202A and 202B of air or another gas through optional openings 204A and 204B in support structure 110. Flow 200A and 20013 create air pressure in insulating regions 134A and 134B. In this embodiment, caps 130 are at least sufficiently sealed against shields 134A and 134B, and at least one of printhead 100 and support structure 110 such that air flows 212A and 21213 are created from openings 138A and 138B in shields 132A and 132B as shown in FIG. 13. It will be appreciated that flows 214A and 214B are approximately parallel to the path of drops 102A and 102B toward target areas 108A and 108B respectively. This approach can provide any or all of the advantages of enhancing the manner in which air flow under caps 130 interacts with flows 202A and 202B coming out of openings 138A and 138B creating an air cushion that resists movement of receiver 24 toward shields 132A and 132B and that provides additional protection against the possibility that receiver 24 will be moved toward and strike shield 132. Further, this flow with the drop flying toward the target area and also provides an air seal to further restrict the extent to which vaporized carrier fluid can pass from the printing areas 136 to the insulating areas 134.

Figure 14:
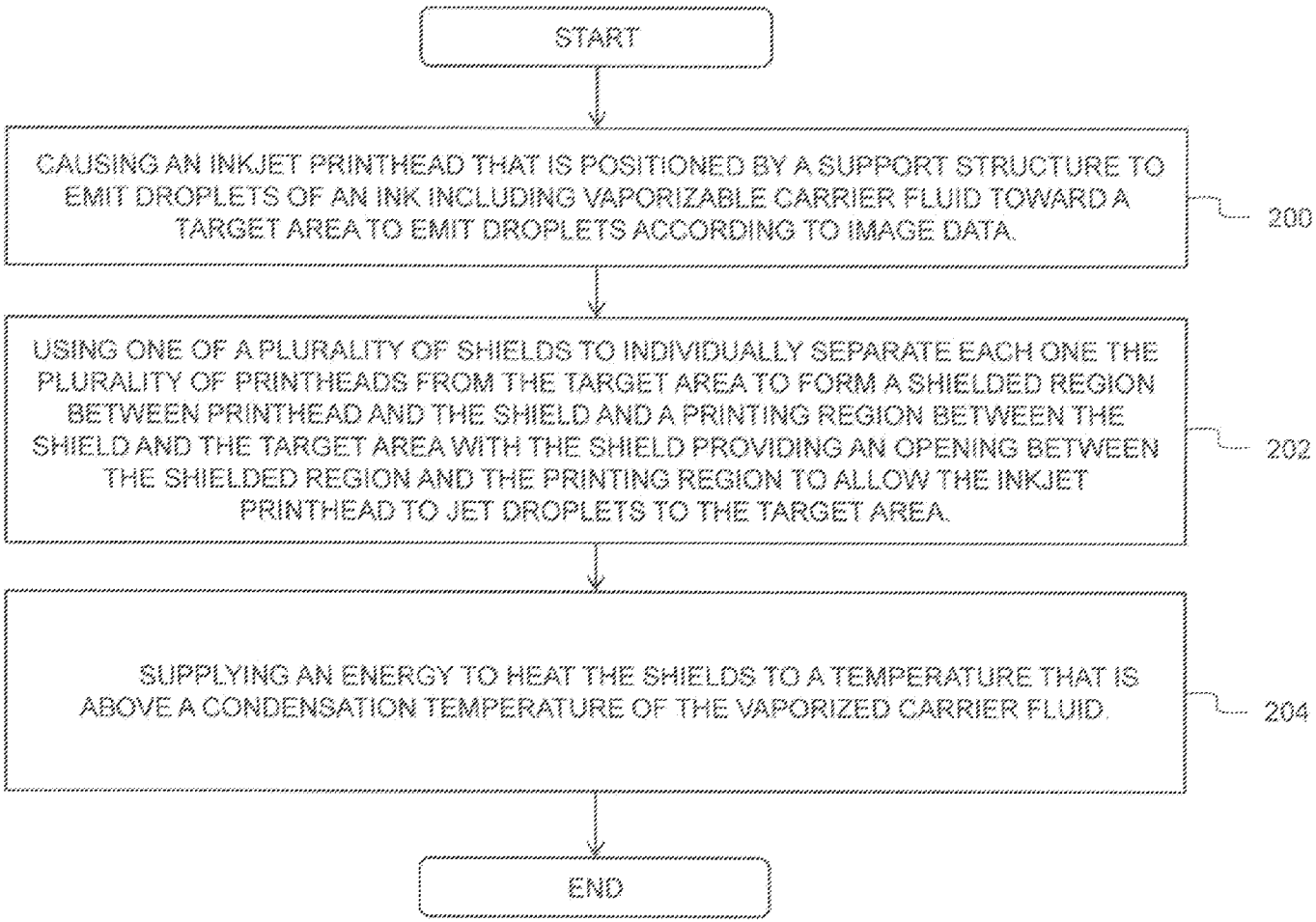
FIG. 14 is a flow chart of one embodiment of a condensation control method.

One embodiment of a method for operating a printing system is provided in FIG. 14 that can be executed whole or in part by printer controller 82 or control circuit 182. As is shown in the embodiment of FIG. 12 a plurality inkjet printheads that are positioned by a support structure to emit droplets of an ink including vaporizable carrier fluid toward a target area are caused to emit droplets according to image data (step 200) and using one of a plurality of shields to individually separate each one the plurality of printheads from the target area to form a shielded region between printhead and the shield and a printing region between the shield and the target area with the shield providing an opening between the shielded region and the printing region to allow the inkjet printhead to jet droplets to the target area (step 202). An amount of energy is supplied to heat the shields to a temperature that is above a condensation temperature of the vaporized carrier fluid (step 204). This energy can be individually supplied to individually heat each of the shields as is described in greater detail above.

It will be appreciated that the drawings provided herein illustrate arrangements of components of various arrangements components of condensation control system 118.

Unless otherwise stated herein, these arrangements are not limiting. For example and without limitation inkjet printing system 20, is illustrated with sensors 86, electrical heater 172 and energy source 180 being positioned on a face side 140 of shields 132 that confront printing region 136. However, in other embodiments, and unless stated otherwise these components can be located on sides 142 of shields 132 that confront shielded regions 134.

Additionally, it will be noted that unless otherwise stated herein the drawings are not necessarily to scale.

The invention has been described in detail with particular reference to certain preferred embodiments thereof, but it will be understood that variations and modifications can be effected within the spirit and scope of the invention.

What is claimed is:

1. An inkjet printing system comprising:

a plurality of inkjet printheads, each printhead having nozzles for jetting ink droplets having a vaporizable carder fluid;

a support structure to which the plurality of inkjet printheads are mounted, such that a face of each of the printheads of the plurality of printheads is positioned to jet the ink droplets toward a target area through which a receiver transport system moves a receiver during printing;

a plurality of caps, each cap having a thermally insulating separator that positions a shield between the face of one of the printheads and the target area for the printhead and creating a printing region between the shield and the target area and a shielded region between the face and the shield, with the shield having at least one opening through the shield through which the nozzles of the printhead can jet the ink droplets to the target area; and an energy source provides energy that can be applied to cause the shields to be heated.

2. The inkjet printing system of claim 1, further comprising a control circuit that controls an amount of energy that used to heat each shield in an inkjet printing module the shields can be heated to different temperatures that are each at least equal to a condensation temperature of the vaporized carrier fluid in the printing region for that shield.

3. The inkjet printing system of claim 1, wherein the printheads are continuous inkjet printheads.

4. The inkjet printing system of claim 1, further comprising seals to seal between the shield and the support structure, located adjacent to the perimeter of the shield.

5. The inkjet printing system of claim 1, wherein the shield comprises a sheet of a non-corrosive material.

6. The inkjet printing system of claim 1, wherein the shield is one of a polyamide, polyimide, polyester, vinyl and polystyrene, and polyethylene terephthalate.

7. The inkjet printing system of claim 1, wherein the shield comprises a stainless steel.

8. The inkjet printing system of claim 1, wherein the shield is a sheet material that is less than about 1 millimeter in thickness.

9. The inkjet printing system of claim 1, wherein the opening is approximately 2 mm wide.

10. The inkjet printing system of claim 1, wherein the shield is flexible and is supported by tensioning frame.

11. The inkjet printing system of claim 1, wherein the shield is positioned between the support structure and the target area by a plurality of thermally insulating pins made from at least one of Bakelite, tubular stainless steel and an aerogel.

12. The inkjet printing system of claim 1, wherein the at least one of the shield and a heater are arranged so that energy is applied that heats the shield to a higher temperature away from the one or more openings than proximate to the one or more openings.

13. The inkjet printing system of claim 2, wherein the control circuit has separate circuits so that an amount of energy applied to each shield can be controlled independent of an amount of energy applied to other shields.

14. The inkjet printing system of claim 2, wherein the energy source provides separate flows of a heated medium that contact the shield and that heat different ones of the shields, with the control circuit controlling the extent of each separate flow in order to control the heating of the separate shields.

15. The inkjet printing system of claim 2, wherein the energy comprises a heater that heats a plurality of contact surfaces that are in contact with individual ones of the shields wherein control circuit controls actuators that controls an extent of contact between the shields and the contact surfaces.

16. The inkjet printing system of claim 1, wherein the energy comprises a heater that heats a plurality of contact surfaces that are in contact with individual ones of the shields and wherein the control circuit controls an amount of heat supplied by the energy source to each of the contact surface.

17. The inkjet printing system of claim 1, further comprising a plurality of relative humidity sensor with a sensor positioned at each of the printing regions and operable to generate a relative humidity signal that is indicative of as a ratio of the partial pressure of carrier fluid vapor in an air-carrier fluid mixture in the second region to the saturated vapor pressure of a flat sheet of pure carrier fluid at the pressure and temperature of each of the printing regions and wherein the control circuit controls heating of the shields according to the sensed relative humidity in the printing regions associated with the shields.

18. The inkjet printing system of claim 1, further comprising a liquid condensation sensor located proximate to each of the shields and operable to detect condensation on sides of the shields facing the printing region and wherein the control circuit controls heating of the shields according to the sensed relative humidity in the printing regions associated with the shields.

19. The inkjet printing system of claim 1, further comprising an intermediate shield between printhead and the shield to define an intermediate region joined that is joined to the shielded region by way of an intermediate opening through which the ink jet droplets can be jetted.

20. The inkjet printing system of claim 19, wherein the intermediate shield has an intermediate opening that is smaller than the opening in the shield, to further limit the extent to which vaporized carrier fluid travels from the printing region into the shielded region.

21. The inkjet printing system of claim 1, wherein a flow of air is supplied through the first regions.

22. The inkjet printing system of claim 1, further comprising a blower that creates a flow of air into the first regions such that the air is supplied through the openings of the shields, with the air flow being approximately parallel to the path of the drops toward the target area, to enhance the manner in which the air flow under the shields interacts with the air flow coming out of the openings and also interacts with the drop flying toward the target area.

23. The inkjet printing system of claim 1, wherein the shields extend upstream from the nozzle array that jets droplets through opening by a distance that is greater one fourth of the length of the nozzle array length.

24. The inkjet printing system of claim 1, wherein the shield extends upstream from the nozzle array by a distance that is greater one third of the length of the nozzle array length.

* * * * *